US006797066B2

(12) United States Patent
Yoshino et al.

(10) Patent No.: US 6,797,066 B2
(45) Date of Patent: Sep. 28, 2004

(54) APPARATUS AND METHOD FOR POWDER COATING

(75) Inventors: Koshiro Yoshino, Shizuoka (JP); Michio Suganuma, Shinagawa-ku (JP); Tadahiko Koyanagi, Shizuoka (JP)

(73) Assignee: Kabushiki Kaisya Yoshino Kosakujo, Shizuoka (JP)

( * ) Notice: Subject to any disclaimer, the term of this patent is extended or adjusted under 35 U.S.C. 154(b) by 65 days.

(21) Appl. No.: 10/101,722

(22) Filed: Mar. 21, 2002

(65) Prior Publication Data

US 2002/0134311 A1 Sep. 26, 2002

(30) Foreign Application Priority Data

Jun. 29, 2001 (JP) ..... 2001-197772

(51) Int. Cl.[7] ..... B05C 13/00; B05C 14/00; B05B 5/025

(52) U.S. Cl. ..... 118/500; 118/621; 118/308; 239/690.1

(58) Field of Search ..... 118/308, 309, 118/500, 66, 319, 620, 621; 219/600, 647, 649, 671; 211/119, 198; 239/690.1

(56) References Cited

U.S. PATENT DOCUMENTS 2,445,451 A * 7/1948 Padelford ..... 118/319
2,844,489 A * 7/1958 Gemmer ..... 118/309
4,243,146 A * 1/1981 Davitz ..... 211/118
4,496,818 A * 1/1985 Reynolds et al. ..... 219/649
4,837,904 A * 6/1989 Abe et al. ..... 29/34 R
5,023,419 A * 6/1991 Langstedt ..... 219/671
5,107,789 A 4/1992 Salisbury
5,362,326 A * 11/1994 Hasui et al. ..... 118/308
5,495,094 A * 2/1996 Rowan et al. ..... 219/671
5,776,249 A 7/1998 Rutz

FOREIGN PATENT DOCUMENTS

| | | |
|---|---|---|
| DE | 42 17 754 A 1 | 12/1993 |
| DE | 197 04 779 A 1 | 6/1998 |
| GB | 781594 | 8/1957 |
| GB | 887159 | 1/1962 |
| GB | 913642 | 12/1962 |
| GB | 1101134 | 1/1968 |
| GB | 1 472 079 | 4/1977 |

* cited by examiner

*Primary Examiner*—J. A. Lorengo
*Assistant Examiner*—Yewebdar Tadase
(74) *Attorney, Agent, or Firm*—Oliff & Berridge, PLC

(57) ABSTRACT

Provided is an apparatus for powder coating 1 which includes a coat-applying station 39 for applying a powder coating P on a work 3 to be coated, and a high frequency induction heating apparatus 47 for heating the work 3 covered with the powder coating P under the effect of high frequency wave and baking the powder coating P on the work at the interface defined between the powder coating and the work. Use of the apparatus 1 provides a uniform and strong coating film without any unevenness more efficiently with the relatively compact apparatus.

8 Claims, 12 Drawing Sheets

【Fig. 1】
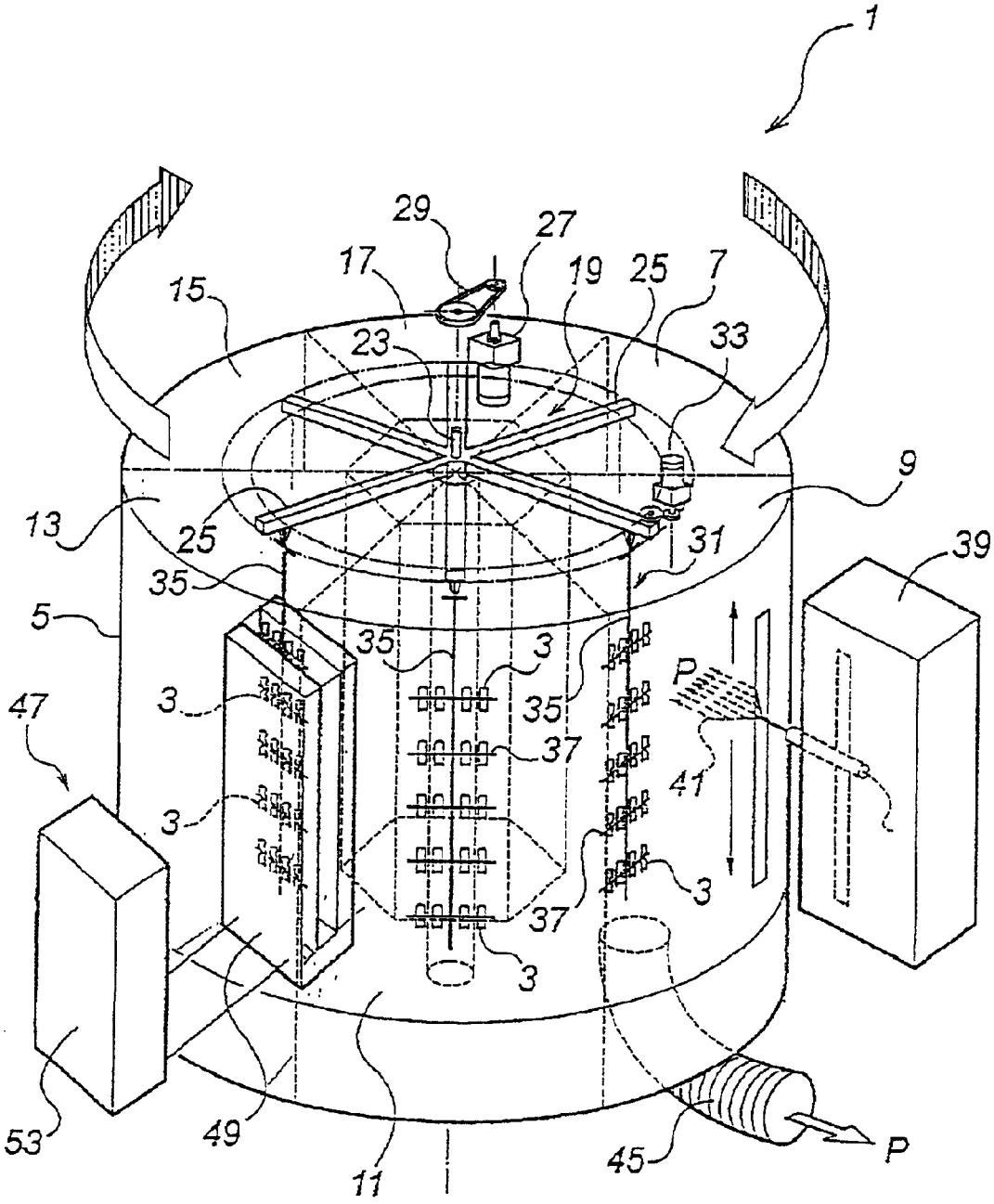

【Fig. 2】
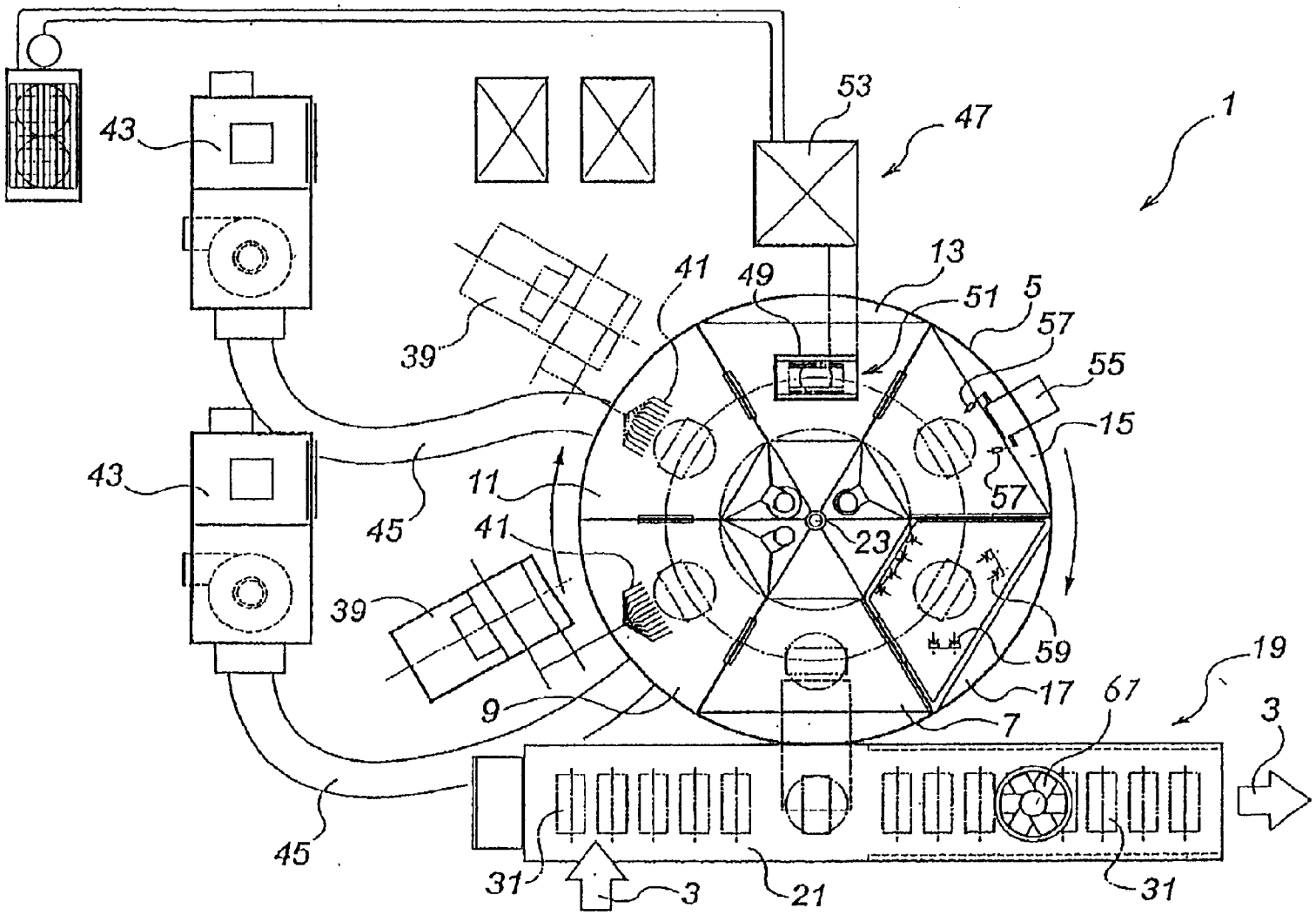

【Fig. 3】
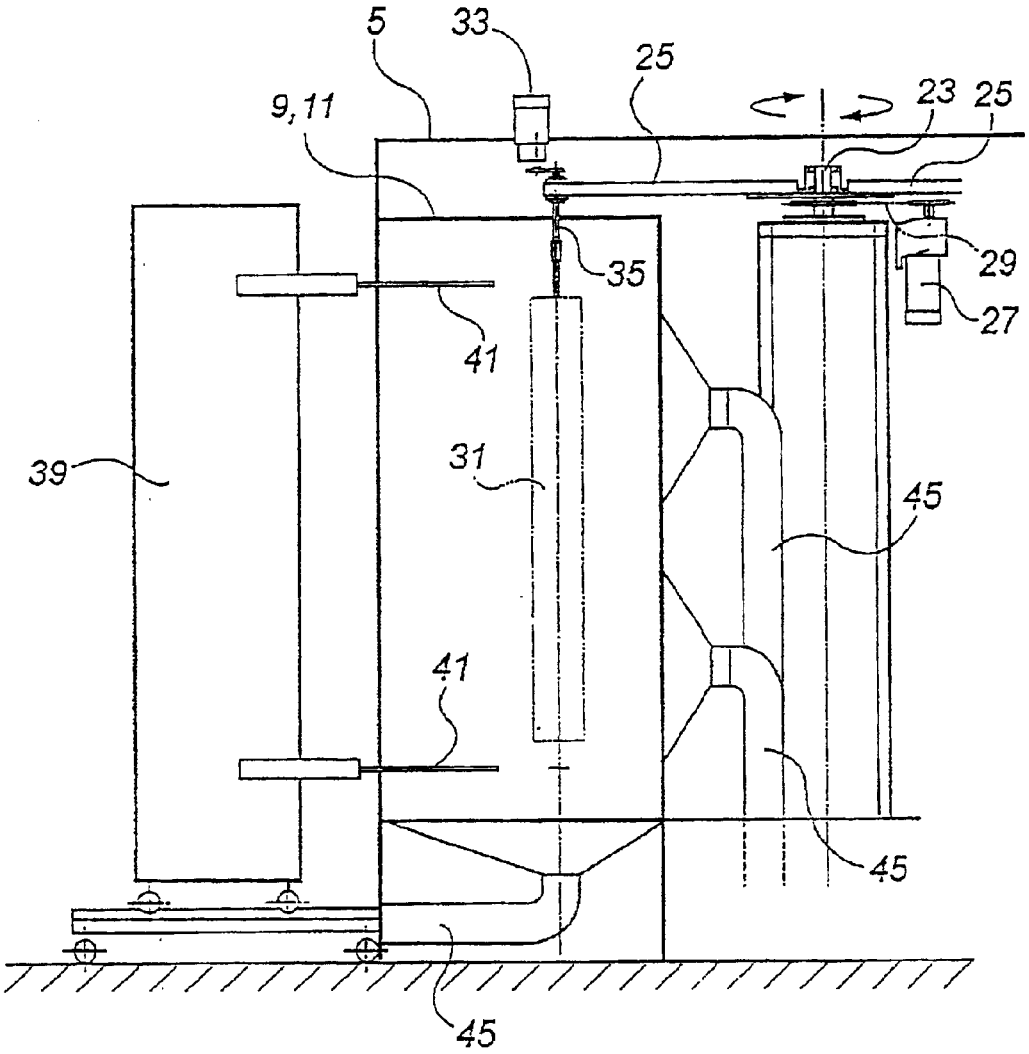

【Fig. 4】
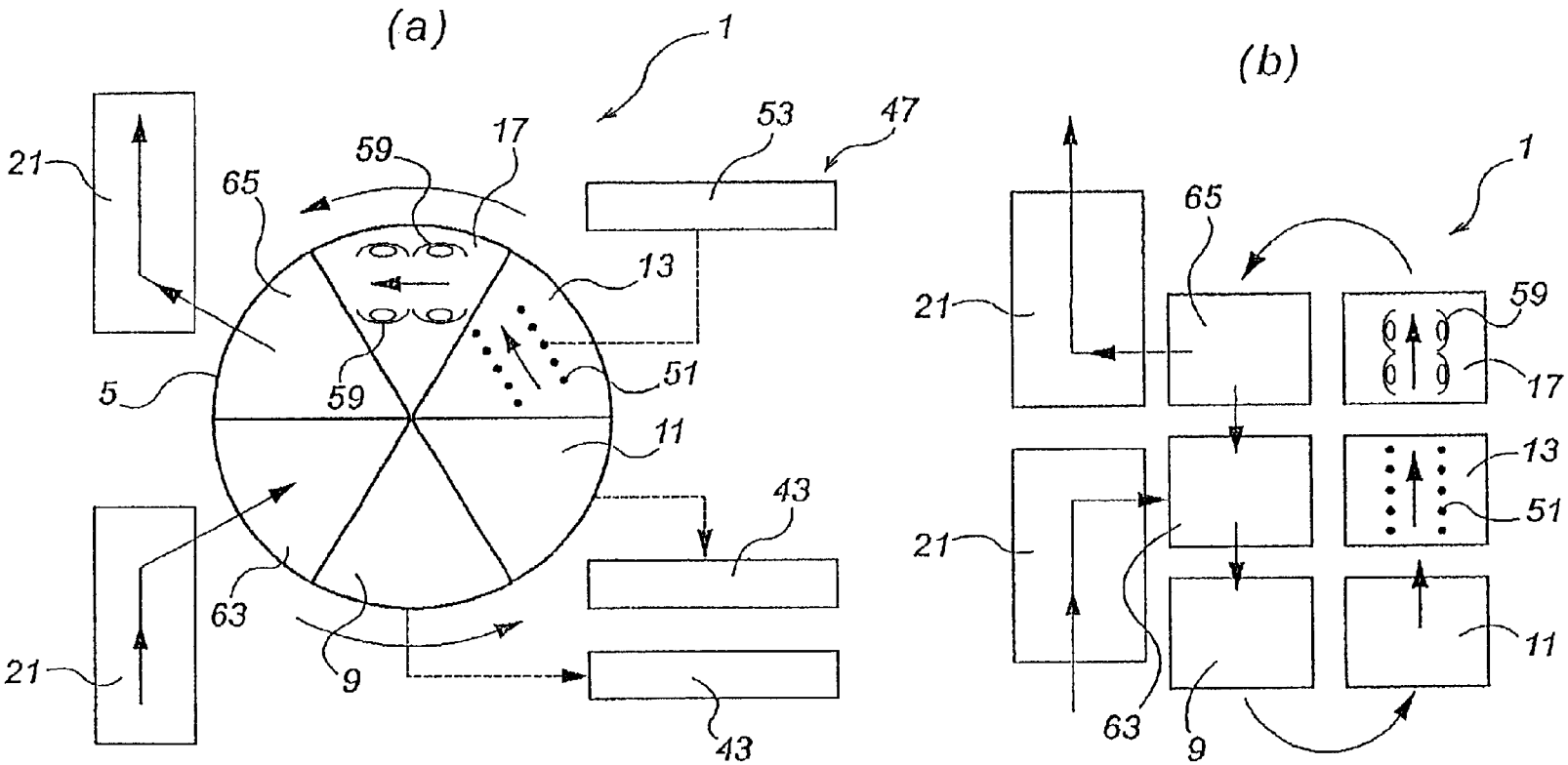

【Fig. 5】
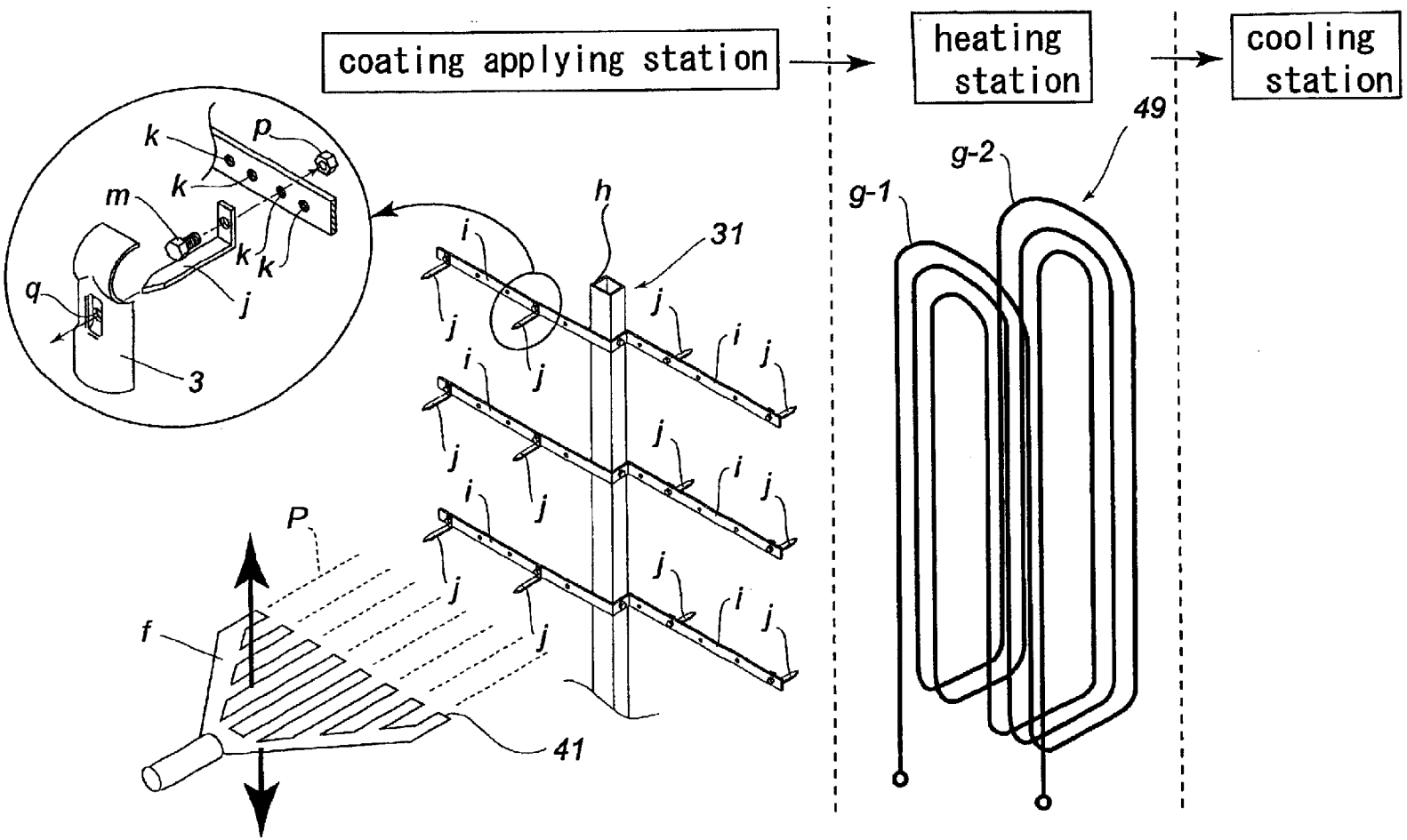

【Fig. 6】
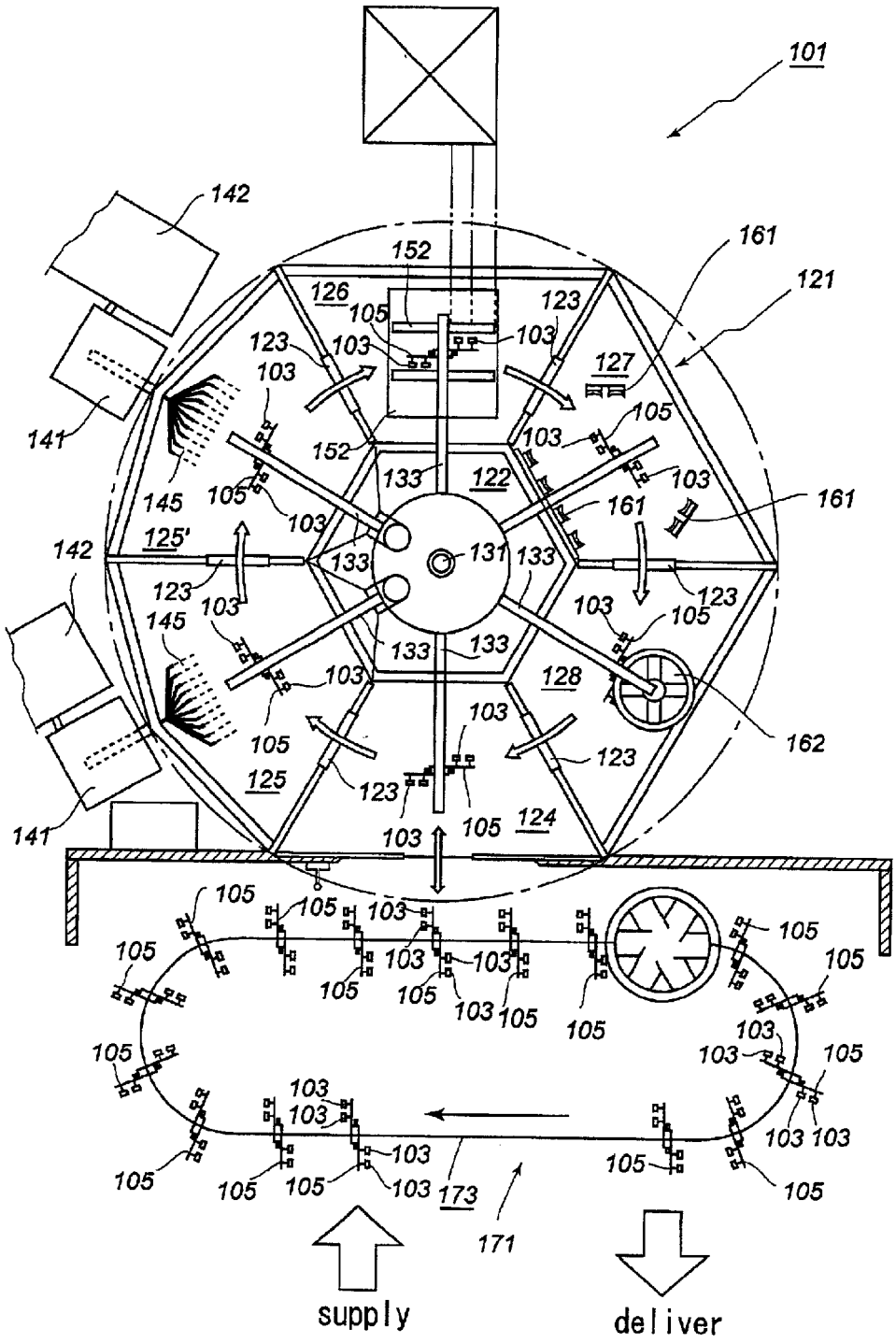

【Fig. 7】
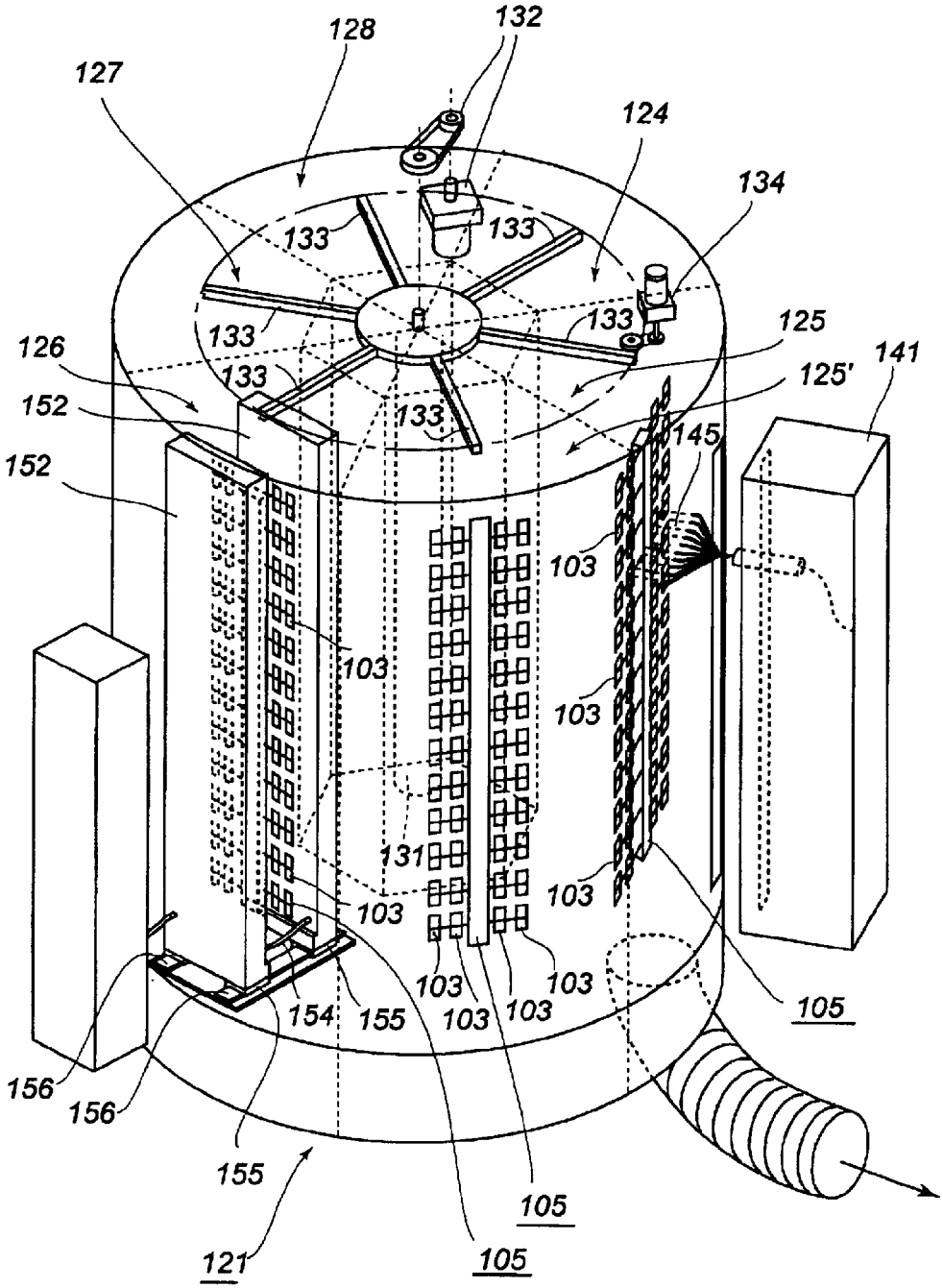

【Fig. 8】
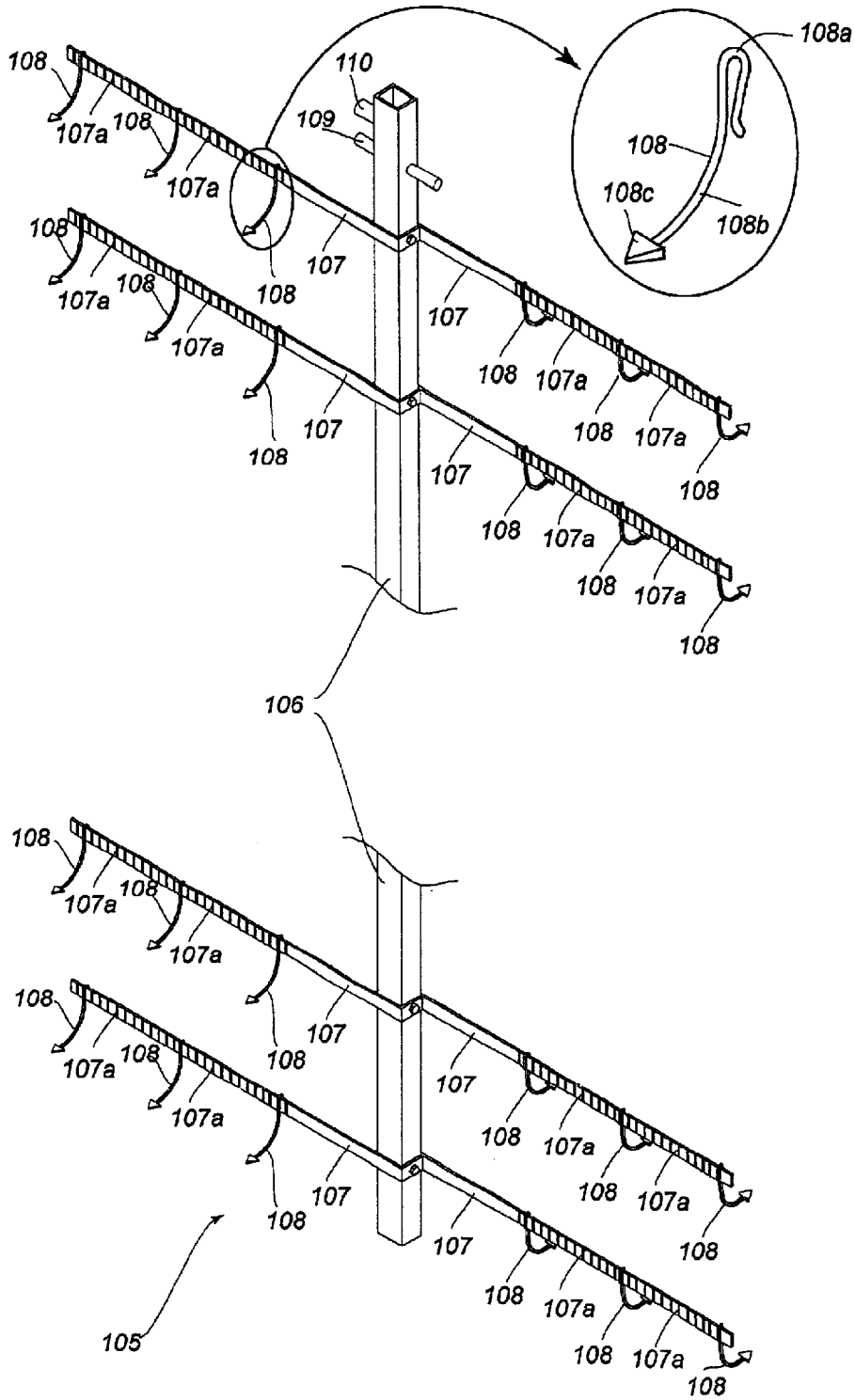

【Fig. 9】
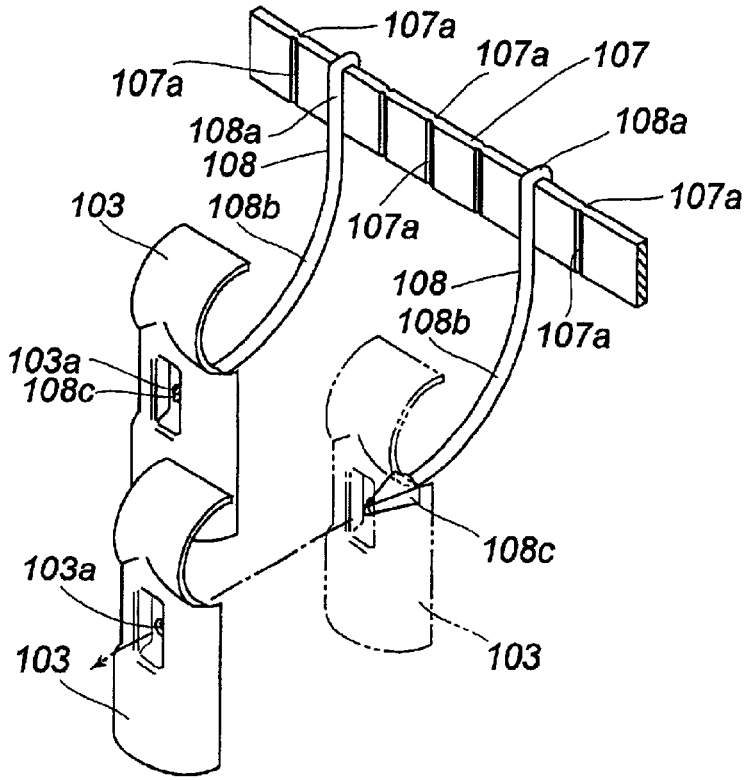
【Fig. 10】
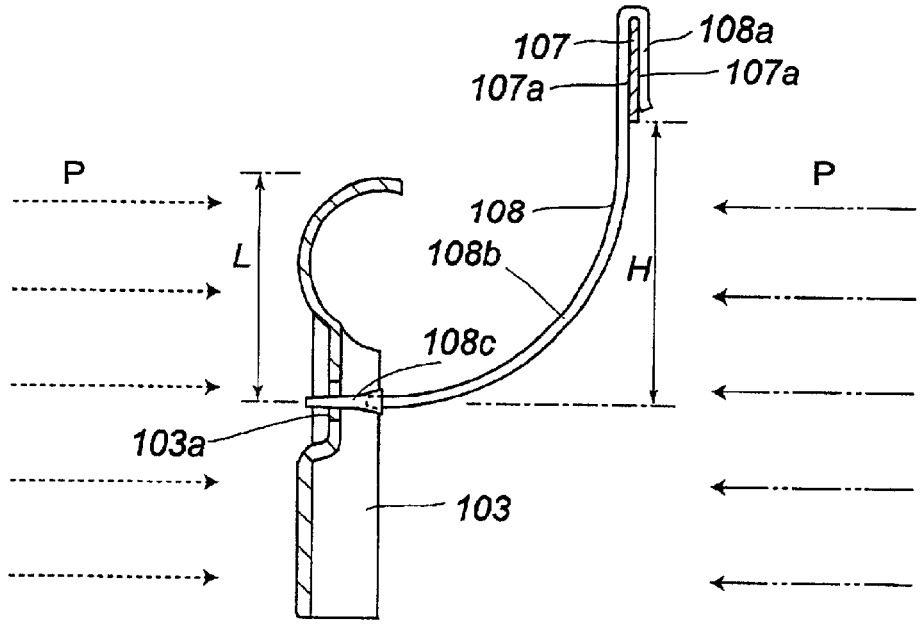

【Fig. 11】
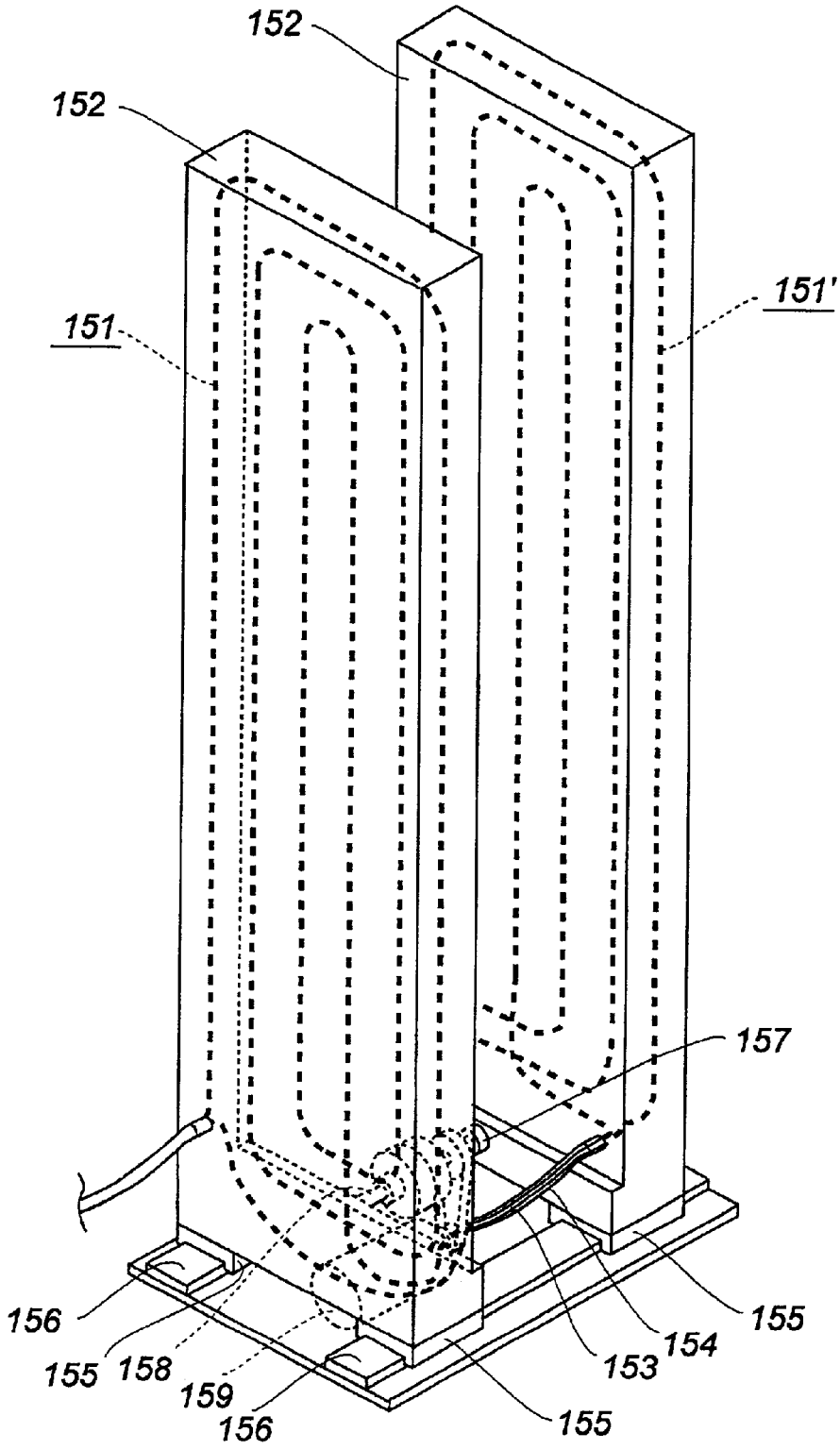

【Fig. 12】
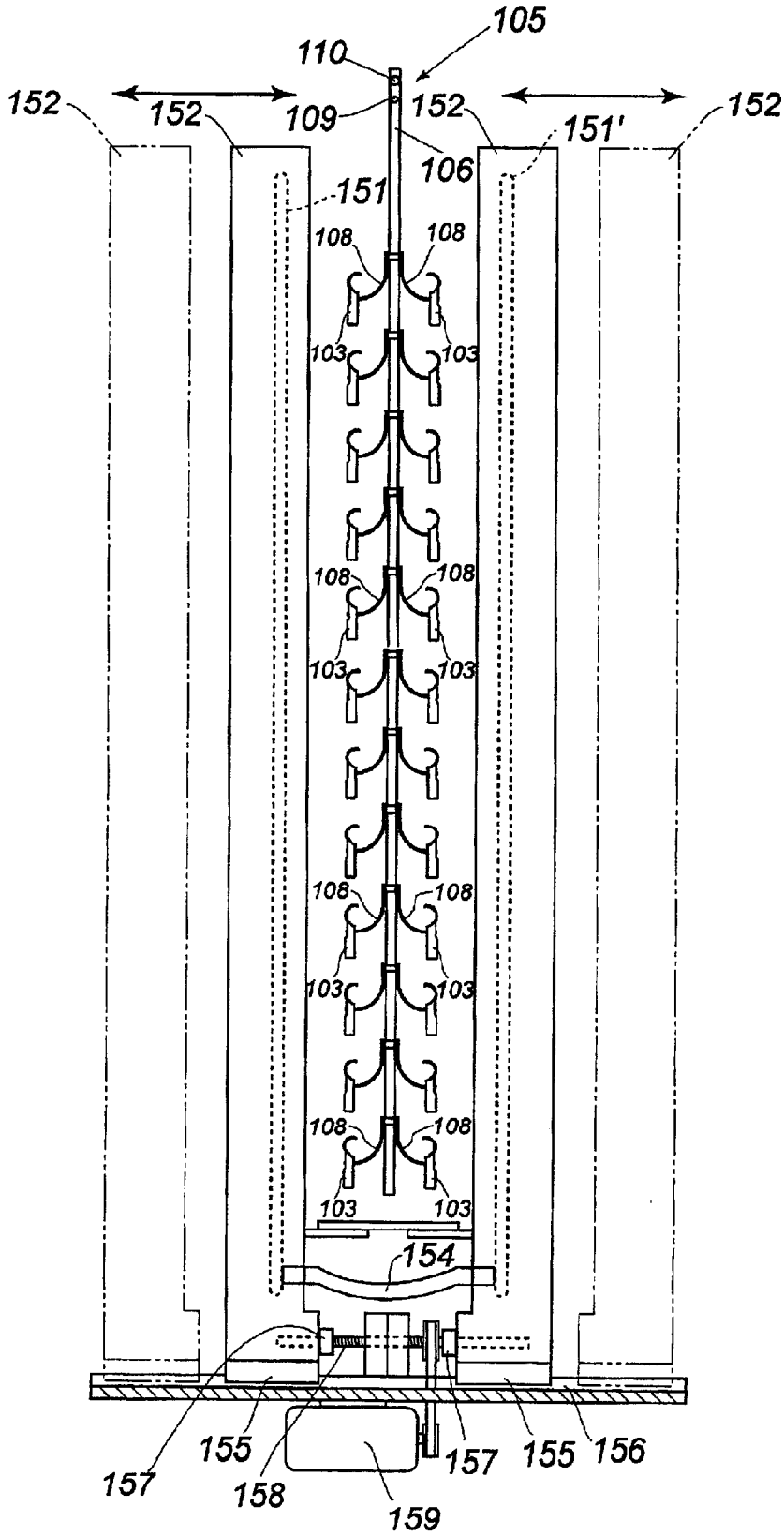

【Fig. 13】
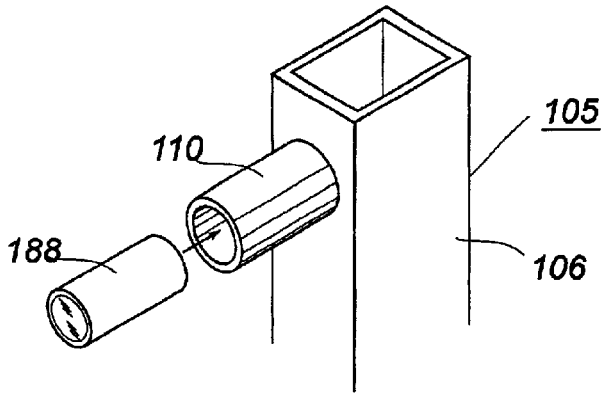
【Fig. 14】
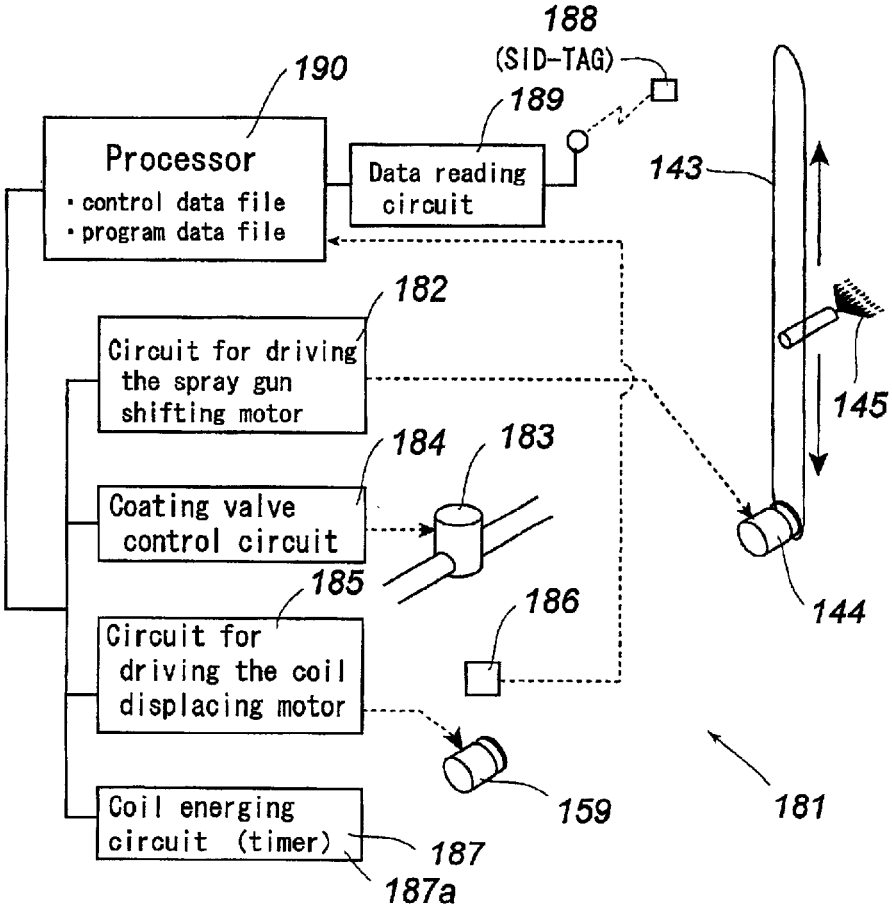

APPARATUS AND METHOD FOR POWDER COATING

BACKGROUND OF THE INVENTION

1. Technical Field

The present invention relates to an apparatus and a method for powder coating, which provide a uniform and strong coating film without any unevenness on works of complex configuration such as tube fitting of iron material, and a powder coat-applying apparatus for carrying out the same. The present invention relates more particularly to an apparatus and a method for powder coating, which enhance the adhesion property of the coating film with respect to the works, thus improving the efficiency of coating operation by eliminating the degreasing step, and for improving the productivity thereof.

2. Description of the Prior Art

In the coat-applying process of the prior art, after a degreasing step for removing the contaminant such as grease adhered on the surface of the works to be coated is effected, a cleaning step, a drip out step, and a drying step are also carried out. Then a coat-applying step, a drying and baking process by irradiating the extreme infrared ray, and cooling step are carried out.

However, when the works of complex configuration are to be dried and baked by irradiating the extreme infrared ray, the surface of the coating is tend to be baked excessively and the adhering surface of the coating is tend to be baked short of the need so that the uneven coating may be formed. Further, the drying and baking process by irradiating the extreme infrared ray is time-consuming process. If it is intended to dry uniformly by irradiating the extreme infrared ray, the coat-applying device will inevitably be enlarged, so that the space and the cost required for establishing the apparatus are also increased substantially.

Further, in the above-mentioned method for coating, the degreasing process must be made before coating the works. Since in the case that the heat is adapted to be provided by irradiating the extreme infrared ray from the outside of the works, the contaminant such as grease interposed between the work and the coating will bring the short of adherence or the separation between the works and the coating film. It is thus reasonable to make degreasing operation on all works respectively. However, the degreasing operation is very cumbersome and is an obstacle to the increased efficiency of the coating process.

A hanger on which a plurality of the works is hanged is employed in the coating operation. During the repeatedly effected coating operations, the coating material scattered around the hanger is adhered thereon, and strongly adhered thereon through the effect of heating operation. It has therefore been necessary to make an extra operation to peel off the adhered coating material from the hanger.

Accordingly the object of the present invention is to eliminate the difficulties involved in the prior art and provide a novel and useful relatively compact coat-applying apparatus for forming a uniform and strong coating film without any unevenness in more efficient manner, and the methods for effecting the same.

SUMMARY OF THE INVENTION

These and other objects may be achieved by the apparatus and the method in accordance with the invention as defined in claims.

In accordance with a first embodiment of this invention, provided is an apparatus for powder coating of high frequency induction heating type comprising a coat-applying station for applying a powder coating on a surface of a work to be coated, and a heating station for baking the powder coating by heating the work covered with the powder coating through the high frequency induction heating.

In accordance with a second embodiment of this invention, the coat-applying apparatus is further provided with a hanger for hooking the work, and wherein the hanger is made of a material to which no influence of the high frequency wave can be incurred.

In accordance with a third embodiment of this invention, the apparatus further includes a carrier for displacing the works on a circular horizontal transferring track.

In accordance with a fourth embodiment of this invention, provided is a method for powder coating under the influence of high frequency induction heating including the process steps of a coat-applying process for applying the powder coating on a surface of the work to be coated, and a heating process for baking the powder coating from the interface with each work by heating the work covered with the powder coating through the high frequency induction heating.

In accordance with a fifth embodiment of this invention, the apparatus of the high frequency induction heating type comprises a plurality of process stations including a coat-applying station for applying the powder coating on the work to be coated, and a heating station for baking the powder coating by heating the work covered with the powder coating through the high frequency induction heating, a hanger including hook-mounting bars on which hooks are mounted and a hanger-transfer means for transferring the hanger sequentially to each of the plurality of process stations, wherein the hook includes a mounting-member bended in an inverted "U" shape and an arm extending from one end of the mounting-member, and the hook-mounting bar is provided with a plurality of vertically extending recesses spaced apart in the longitudinal direction of the member for removably engaging the mounting-member of the hook.

In the coat-applying device of the structure as mentioned above, the hook can be connected to the hook-mounting bar by mounting the mounting-member of the hook on the bar at any selected vertically extending recess. Thus the hook can be held stably through the engagement of the mounting-member with the recess. The hook can also be removed easily by pulling the mounting-member from the recess.

Thus the hook can be mounted on or removed from the hook-mounting bar only by one action. In this connection, the hook mounted on the hook-mounting bar may be exchanged quickly with another kind of hook in accordance with the shape or the size of the work to be coated. The number of the hooks to be mounted on the bar can be changed easily in accordance with the shape or the size of the work to be coated. The spacing between the hooks can be varied easily in accordance with the shape or the size of the work to be coated. Further, such operation can be effected for adjusting the distance between works and the high frequency induction coils.

The hooks for works are preferably made from a material on which the powder coating is not adhered such as a wire of phosphor bronze. If the mounting-member is formed as a clip configuration, the hook may further be held stably on the hook-mounting bar.

In accordance with a sixth embodiment of this invention, the mounting-member and the arm of the hook are formed from a wire of circular cross section, the top end of the arm extends downwardly from the mounting-member, and a hook portion of an arrow head shape for hanging the work is secured on the top end of the arm. In this connection, the interference due to the foot print of the hook on the flow of injected coating material can be inhibited by making the height of the hook longer than the dimension of the work measured from the hook hole to the upper end thereof, i.e. by positioning the work entirely below the hook-mounting bar. The interference can further be inhibited by making the mounting-member and the arm of the hook from a thin wire. Thus, the problem of uneven coating can be eliminated.

In accordance with a seventh embodiment of this invention, the apparatus includes a plurality of process stations including a coat-applying station for applying the powder coating on the work to be coated, and a heating station for baking the powder coating by heating the work, which has been covered with the powder coating, through the high frequency induction heating, a hanger including hook-mounting bars on which hooks are mounted, and a hanger-transfer means for transferring the hanger sequentially to each of the plurality of process stations, wherein, a pair of high frequency induction coils are arranged in the heating station opposite to each other with disposing the hanger-transferring passage therebetween.

Thus it is unnecessary to form a bending portion on the coil so that the intensity of the inducing effect may hardly be varied, and all works positioned opposite to the coils can be heated uniformly.

In the practice of the present invention, the two coils may be separated in their circuit. However, the means for supplying electric energy to these coils can be simplified by connecting both circuits to unify the circuits with a wire material in which no eddy current would be induced.

In accordance with an eighth embodiment of this invention, the pair of high frequency induction coils are supported on coil supporting bases respectively, the bases can be displaced in opposite directions so that the spacing defined between the coil cases can be enlarged of narrowed, and a coil position control means for controlling the displacement of the coil supporting bases is provided.

In such an arrangement, the distance between coils and the distance between each coil and the works can be adjusted, so that the distance between coils can be enlarged upon transferring the hanger into the heating station, and then the coils can be displaced to the position optimum in the heating operation. In this connection, a variety of sizes of the works can be processed, and the heating condition can be varied in accordance with the kind of the works.

In accordance with a ninth embodiment of this invention, the apparatus includes a tag for storing a position control data of the pair of high frequency induction coils or a representative data thereof, adapted to be mounted on the hanger, a data reading circuit for reading the data stored in the tag, a processor generating a control signal on the basis of the data read through the data reading circuit, and a control circuit for controlling the position of the coils on the basis of the control signal.

Thus, in accordance with the invention, the position of the coils relative to the works i.e. the condition to be controlled for realizing the optimum heating with respect to the kind of the works or the property of the coating material can be adjusted automatically in accordance with the control data or the representative data stored preliminary in the tag.

In accordance with a tenth embodiment of this invention, the apparatus further includes a plurality of process stations including a coat-applying station for applying the powder coating on the work to be coated, and a heating station for baking the powder coating by heating the work covered with the powder coating through the high frequency induction heating, a hanger including a plurality of hooks mounted thereon in the vertical direction, a hanger-transferring means for transferring the hanger into the plurality of process stations sequentially, a tag storing a control data or a representative data thereof adapted to be mounted on the hanger, a data reading circuit for reading the data stored in the tag, a processor generating on the basis of the data read through the data reading circuit a control signal with respect to at least one of the following items to be controlled such as the number of the shifting operation of the spray gun, the amount of the coating to be injected from the spray gun, and the time for heating by means of the high frequency induction coils, and a control circuit for controlling on the basis of the control signal the above mentioned items to be controlled.

In accordance with the invention, the apparatus can be adjusted automatically in accordance with the control data or the representative data stored preliminary in the tag is at least one of the number of the displacement of the spray gun, the amount of the coating material to be applied, and the time for heating by means of the high frequency induction coils i.e. at least one of the conditions to be controlled for realizing the optimum coating application or the optimum heating with respect to the kind of the works or the property of the coating material.

As can be seen from the above, in the invention, one or a plurality of the conditions to be influenced on the coat-applying operation or the quality of the baked coating can be controlled automatically and in optimum with respect to the kind of the works and the coating material. Thus, the inefficient operation, such as stopping the line and/or adjusting the position of the coils required conventionally for changing the condition to be controlled upon varying the kind of the works can be eliminated.

In accordance with the present invention, the coat-applying operation of the hangers can be done under the optimum process condition in accordance with their own control data and the representative data, so that even the hangers of smaller lot can be processed in optimum.

The method for storing data to be adopted in the invention can either be the method for storing the control data in the tag, or the method for storing the concrete control data of each work in the data file and storing only the representative data such as the number identifying the work in the tag. Provided that the SID-TAG SYSTEM is intended to be used, the latter method may be adopted.

BRIEF DESCRIPTION OF THE DRAWINGS

Further feature of the present invention will become apparent to those skilled in the art to which the present invention relates from reading the following specification with reference to the accompanying drawings, in which:

FIG. 1 is a perspective view showing the powder coat-applying apparatus of the first embodiment of the present invention;

FIG. 2 is a plan view showing the powder coat-applying apparatus shown in FIG. 1;

FIG. 3 is a vertical cross sectional side view of the powder coat-applying apparatus shown in FIG. 1 in which the station for coating the works with powder is shown;

FIG. 4 is a schematic block diagram showing the powder coat-applying apparatus shown in FIG. 1;

FIG. 5 is a schematic perspective view showing the layout of the coating and heating stations of the other embodiment derived by modifying the first embodiment of the present invention;

FIG. 6 is a plan view showing the general arrangement of the powder coat-applying apparatus of the second embodiment of the present invention;

FIG. 7 is a perspective view showing the essential portion of the powder coat-applying apparatus shown in FIG. 6;

FIG. 8 is an enlarged perspective view showing the hanger employed in the powder coat-applying apparatus shown in FIG. 6;

FIG. 9 is an enlarged detailed perspective view showing the manner for attaching the works to be coated to the hooks;

FIG. 10 is a side view showing the work attached to the hook;

FIG. 11 is an enlarged perspective view showing the heating device of the powder coat-applying apparatus shown in FIG. 6;

FIG. 12 is an enlarged side view showing the heating device of the powder coat-applying apparatus shown in FIG. 6;

FIG. 13 is an enlarged perspective view showing the tag socket provided on the hanger employed in the powder coat-applying apparatus shown in FIG. 6; and FIG. 14 is a schematic block diagram showing the control system used in the powder coat-applying apparatus shown in FIG. 6.

DETAILED DESCRIPTION OF THE PRESENT INVENTION

A powder coating apparatus 1 of the first embodiment of the present invention will now be described with reference to FIGS. 1–4.

The powder coating apparatus 1 of the present invention can be employed for applying coating on iron works 3 of complex configuration such as the tube fittings of iron material.

Concretely, the powder coating apparatus includes a cylindrical process chamber 5 subdivided into six process stations 7, 9, 11, 13, 15, and 17, and a variety of appurtenance facilities for each process to be effected in the stations, as well as a carrier arrangement 19 for holding the works 3 and conveying them into the chamber as illustrated in FIGS. 1 and 2.

The transfer station 7 is served to accept the works 3 conveyed through the conveyer 21 from the outside of the chamber, and to deliver the coated works into the conveyer 21. The chamber also has a central spindle shaft 23 and six arms 25 extending radially from the top of the spindle shaft 23. The number of the arms shown in the figure is only for an illustrative purpose and not limiting the same.

The spindle shaft 23 is adapted rotatively by means of an arm driving motor 27 through a convenient driving mechanism 29 such as a chain or a timing belt.

The arms 25 include on their free end hangers 31 for hanging the works 3. The hangers 31 are arranged rotatively for example for 180 degree through the reverse operation of motor 33.

The hanger 31 includes a vertically extending hanging rod 35 and a plurality of suitably spaced apart holding levers 37 secured on the rod so as to extend horizontally therefrom. The hanger 31 may be formed of a material such as copper which can not be heated under the effect of high frequency wave.

The above-mentioned carrier arrangement 19 is comprised of the spindle shaft 23, the arms 25, the driving motor 27, the driving mechanism 29, the hanger 31, and the conveyer 21.

In the work transfer direction a coat-applying station 9 is provided adjacent to the transfer station 7, and a coat-applying station 11 is provided adjacent to the coat-applying station 9. The coat-applying stations 9 and 11 substantially identical in their structure are adapted to be provided in tandem in order to make it possible to produce many kind of and small amount of products. A comb shaped spray nozzle 41 of a coat-applying device 39 is directed toward the inside of each of the coat-applying stations 9 and 11. The coat-applying device 39 is positioned outside of the process chamber 5.

The coat-applying device 39 is a device for applying the powder coating P onto the surface of the work 3 under the effect of the electrostatic induction. The reason why the powder coating P is employed is that the solvent included in the liquid paint is a one of the causes of the environmental pollution.

Each of the coat-applying stations 9 and 11 is also provided with a vacuum duct 45. The vacuum duct 45 is connected to the recovering device 43 for recovering the excess amount of powder coating P, which has not been used in coating the works 3. In the work transfer direction a heating station 13 for heating and solidifying or baking the powder coating P applied onto the works is provided adjacent to the coat-applying station 11.

A high frequency induction coil 49 of "U" shaped cross section which is a part of the high frequency induction heating apparatus 47 is provided within the heating station 13 in a position in which the spaced apart open side of the "U" shape is directed upwardly so that the works 3 and the hanger 31 can be pass therethrough. In such a position, the slit defined between the legs of the "U" shape is directed in the work transfer direction.

An electric current is delivered from the induction heating power source 53, which is a part of the high frequency induction heating apparatus 47, to the high frequency induction coils 49 to generate the induction current through the works 3 to heat the powder coating P applied onto the works from the interface therebetween the works and the coating. A coolant passage (not shown) for suppressing the overheating of the high frequency induction coils 49 is provided within the channel defined within the coil.

As can be seen from the above, the powder coating P is adapted to be heated and baked from the interface between the coating and the work through induction heating with high frequency wave. Contaminant such as a small amount of grease present on the surface of the work will be heated and evaporated and the lost from the interface between the coating and the work so that the shortage of the intimate contact between the coating and the work can be eliminated. Of course, the degreasing procedure necessitated in the prior art can also be eliminated.

The powder coating P rested on the hanger 31 cannot be heated and may remain the form as it was, since the hanger 31 is made of the material such as copper, which cannot be heated under the influence of the high frequency wave. Thus the powder coating remaining on the hanger 31 can be easily removed by blowing a jet of a high-pressure air.

An air blow station 15 for blowing off the powder coating P remaining on the surface of the coating film on the work 3 and the hanger 31 is provided adjacent to the heating station 13 in the work transfer direction. Jet nozzles 57 of the air blower 55 are directed toward the air blow station 15. An auxiliary baking station 17 for heating auxiliary the surface of the coating formed on the work 3 is provided adjacent to the air blow station 15 in the work transfer direction. The auxiliary baking station 17 is provided with a plurality of extreme infrared ray lamps 59 of the power of 2 kW for assuring that the coating can be baked uniformly without any unevenness. The baking operation effected in the auxiliary baking station 17 by means of the extreme infrared ray lamps 59 is to be made only as an auxiliary means, since the baking operation can be completed through the effect of high frequency induction heating.

The transfer station 7 served to connect the chamber with the outside is provided adjacent to the auxiliary baking station 17 in the work transfer direction. The coated works 3 are taken into the transfer station 7 and transferred to the conveyer 21 provided in front of the transfer station 7. The work and the coating thereon are adapted to be cooled by the cooling fan 61 provided on the output side of the conveyer 21.

The process steps done in the powder coat-applying apparatus 1 will now be described sequentially.

<Work Accepting Procedure>

The hanger 31 and works 3 set thereon are transported for a predetermined distance on the conveyer 21, and then transferred into the transfer station 7 by means of any suitable transferring mechanism. Upon transferred into the transfer station 7, the upper end of the hanging rod 35 of the hanger 31 is coupled to the free end of the arm 25. Thus the works can be displaced within the process chamber 5 on the circular horizontal transferring track.

<Coat-applying Procedure>

The works 3 taken into the process chamber 5 through the transfer station 7 are displaced for a predetermined angle into the coat-applying station 9 or 11. In the coat-applying station 9 or 11, the powder coating P is injected from the nozzles 41 of the coat-applying device 39 and adhered on the surface of the works 3 under the effect of electrostatic induction.

The hanger 31 is turned there around over the angle of 180 degree by the reverse motion of the motor 33 so that the powder coating P may be adhered thoroughly over the surface of the works 3 on the hanger 31. The excess amount of the powder coating, which is not adhered on the works, can be recovered by means of the recovering device 43.

<High Frequency Induction Heating Procedure>

Subsequently, the works 3 are displaced into the heating station 13 and positioned within the slit 51 of the high frequency induction coil 49. The works 3 are heated under the effect of the high frequency wave generated from the high frequency induction coil 49 powered by the induction heating power source 53. The powder coating P applied on the surface of the work 3 is adapted to be heated and baked over the interface between the coating and the work. At the same time, the contaminant such as grease adhered on the surface of the work 3 is also heated, evaporated, and eliminated. The temperature at which the grease is evaporated is lower than the temperature at which the powder coating P is baked or solidified, so that the evaporated contaminant such as grease can be escaped through the interstices between particles of the powder coating P even after applying the powder coating on the works 3.

The evaporated and fumed contaminant such as grease may be adsorbed and filtered through any suitable absorption device (not shown). Thus the clean air without any contaminant can be delivered out of the chamber.

<Air Blow Procedure>

The works 3 having a coating film formed through the above mentioned high frequency induction heating procedure are displaced into the air blow station 15 in which the excessive powder coating P adhered on the surface of the coating film can be dusted off by the air flow injected from the air blower 55. At the same time, the powder coating P adhered on the hanger can also be dusted off.

<Auxiliary Baking Procedure>

The works 3 are then displaced into the auxiliary baking station 17 and irradiated with the extreme infrared ray lamps 59 to undergo the auxiliary baking procedure. Thus, it can be assured that the coating may be baked uniformly without any unevenness.

<Product Delivering Procedure>

The works 3 are then displaced into the transfer station 7 and further transferred to the conveyer 21 positioned outside of the process chamber by means of any suitable transferring mechanism. The coated works will be cooled on the conveyer 21 by the cooling fan 61, and delivered as completed products.

As can be seen from the above, the hangers 31 with the works 3 hanged thereon are taken from the conveyer 21 one after another into the process chamber 5, processed through the above mentioned procedures, delivered back to the conveyer 21, and then transported as complete products.

FIG. 5 is a view illustrating the structural relationship of the hooks for hanging the works with respect to the elements of the coat-applying apparatus 1.

The works to be coated are adapted to be transferred sequentially through the coat-applying station, the heating station, and the cooling station. As mentioned above, the coat-applying stations 9 and 11 are provided with a spray gun f for delivering from the nozzle 41 the powder coating P charged with static electricity. The nozzle 41 is able to reciprocate in the vertical direction. The heating station 13 is provided with the high frequency induction coil 49 formed by an oblong coil bent in the "U" shape, and the cooling station is provided with the cooling fan 61 and the like.

The hanger 31 includes a vertically extending pole h, an equidistantly spaced apart plurality of horizontally extending hook-mounting bars i secured to the pole, and a plurality of work holding hooks j mounted on the hook-mounting bars i. The hook-mounting bars i are also provided with a plurality of bolt holes k aligned along the longitudinal direction of each bar. The work holding hook j is formed by bending the rectangular piece of strip in substantially "L" shape. The length of the vertically extending leg of the work holding hook may be substantially identical with the width of the hook-mounting bar i. The vertically extending leg is also provided with a bolt hole. The work holding hook can be mounted on the hook-mounting bar by threading a bolt m through the bolt hole of the hook and through the bolt hole k, and by securing the nut P on the bolt. Two or three hooks can be mounted in each branch of the bar extending from the pole.

The distal end of horizontally extending leg of the hook is pointed in a shape of an arrow head. The works are adapted to be hanged on the hooks by inserting each pointed tip into the hook hole q of respective works.

Upon the hanger 31 is transferred into the coat-applying station 9, the spray gun f injects the powder coating P with reciprocating in the vertical direction. Thus the powder coating P may be applied onto the works 3 under the effect of the electrostatic induction.

The hanger 31 is then transferred into the space between the left and right halves g-1 and g-2 of the high frequency induction coil 49, and then the works 3 are heated from the inside thereof. The temperature of the heated works is adapted to be controlled within the range between 250° C. and 280° C. Thus the powder coating P applied on the works 3 may be baked from the interface between the work and the coating.

In the above-mentioned embodiment, the coating is heated from the interface between the work and the coating under the effect of high frequency induction. In this connection the coating may be baked uniformly without any unevenness, the time required for baking the coating can be reduced, and the coat-applying device can be miniaturized.

The contaminant such as grease adhered on the surface of the works 3 will be evaporated and disappeared under the effect of high frequency induction heating so that the degreasing procedure, which inevitably is required in the prior art can be eliminated. This leads to the substantial enhancement of the operating efficiency.

Further, the problem such as the environmental pollution caused by the solvent included in the liquid paint can also be avoided, since the powder coating P is employed in the present coat-applying process. The excess amount of the powder coating adhered on the hanger 31 cannot be baked and cannot be adhered strongly thereon. This is because the hanger is made of a material such as copper, which cannot be heated by high frequency wave. Thus the powder coating can be dusted off easily from the hanger.

While the first embodiment of the present invention have been described in detail, it should be obvious to those skilled in the art that various changes and modifications in the design can be made without departing from the spirit and scope of the invention.

Although the above-mentioned embodiment, the coat-applying stations 9 and 11 substantially identical in their structure are provided in tandem, either station can be eliminated or one or more additional coat-applying stations can be added.

Further, it might be possible to provide a structure in which the width of the slit 51 of the high frequency induction coil 49 can be controlled. In such a structure, the works 3 of a variety of sizes can be accommodated, and the temperature of the works can be controlled and/or uniformalized in the high frequency induction heating procedure.

Provided that the excessive amount of powder coating should not be adhered on the surface of the coated film, the air blow procedure utilizing the air blower 55 can be eliminated.

Further, if the uniform coating without any unevenness can be formed only through the high frequency induction heating procedure, the auxiliary baking procedure by means of the extreme infrared ray lamps 59 can also be eliminated.

Although the transferring operation of the works 3 to or from the process chamber 5 is effected by one transferring station 7 in the above-mentioned embodiment, a receiving station 63 only for receiving the works and a delivering station 65 only for delivering the works can be provided as shown in FIG. 4(*a*).

The pathway for transferring the works 3 in the process chamber 5 can be a rotary system as mentioned in the first embodiment and as shown in FIG. 4(*a*), and can be a linearly aligned system, as well as a trolley system as shown in FIG. 4(*b*).

The displacement of the works 3 is not limited to the above-described intermittent mode, and the works 3 can also be displaced in a continuous mode by varying the size of each station and the useful length. If the hanger 31 is coated by PTFE, the cleaning operation of the hanger can be facilitated.

A powder coating apparatus 101 of the second embodiment of the present invention will now be described with reference to FIGS. 6–14.

The powder coating apparatus 101 has a structure in which predetermined process stations are arranged along a circular transferring track.

A work 103 to be coated is a pipe joint of iron material having a hook hole 103*a* at about the central portion thereof. Of course, the work 103 is merely an example of a variety of works to be treated in the powder coating apparatus 101.

<A. Hanger>(See FIGS. 6–10, 12, and 13)

A hanger 105 for hanging the work 103 during transportation will now be described in detail with reference to FIGS. 8–10.

The hanger 105 includes a vertically extending pole 106 of a square cross section, an equidistantly spaced apart plurality of horizontally extending hook-mounting bars 107 secured to the pole 106, a plurality of work holding hooks 108 mounted removably on the hook-mounting bars 107, a pair of hanging lugs 109 protruding horizontally from the top portion of the pole 106, and tag socket 110. These elements of the hanger are made of a material such as phosphor bronze to which no influence of the high frequency wave can be incurred.

The hook-mounting bar 107 is a member of relatively narrow sheet material. The one end of the member is bended at right angle relative to the remaining portion thereof. The hook-mounting bar 107 can be mounted on the pole 106 by bolting the one end of the member on the pole so as to extend horizontally therefrom.

The hook-mounting bar 107 is provided on both surface thereof with a plurality of vertically extending recesses 107*a* of V-shaped cross section spaced apart in the longitudinal direction of the member in a predetermined pitch. The position of each recess provide on the front surface of the member correspond with that on the rear surface, i.e. a pair of front and rear recesses (referred hereinafter to as a recess pair) are provided at the same position on the member.

The hook-mounting bars 107 provided on one side of the pole 106 are aligned with those on the other side of the pole, i.e. a plurality of pairs of hook-mounting bars are aligned on both sides of the pole 106 in symmetrical fashion.

A hook 108 for the work to be coated includes a mounting-member 108*a*, an arm 108*b*, and a hook portion 108*c*. The mounting-member 108*a* and an arm 108*b* are formed by bending a wire of phosphor bronze of circular cross section. The mounting-member 108*a* has a deep U-shape. The distance between the legs of the "U" is substantially equal to the thickness of the hook-mounting bar 107 at each recess pair. The arm 108*b* extends forwardly and downwardly from the mounting-member 108*a* in a shape of the quadrant. The hook portion 108*c* is secured on the tip of the arm 108*b*. The hook portion 108*c* is formed in a shape of an arrow head or isosceles triangle. The arm is adapted to be inserted into a hole provided on the base of the hook portion opposite to the vertex of the triangle, and welded thereto.

The hooks 108 are adapted to be mounted removably on the hook-mounting bar 107 by holding the bar between the legs of the "U" of the mounting-member 108*a* at any recesses pair. The hooks can be held on the hook-mounting bar 107 through the engagement between the hook-mounting-member 108*a* and the recess pair.

Although two or three hooks 108 are usually mounted on each hook-mounting bar 107 (in FIGS. 6 and 7, two hooks are mounted in each bar, and in FIG. 8 three hooks are mounted in each bar), the number of the hooks can be varied in accordance with the shape or size of the works to be coated.

In order to hold the hanger 105 on a hanger suspending bar to be described hereinbelow, the pole 106 includes the hanging lugs 109 extending through the upper end portion of the pole in a direction parallel to the hook-mounting bars 107.

The pole 106 is also provided in a position upper than the lugs 109 with a short cylindrical tag socket 110 (see FIG. 8) extending horizontally therefrom. The tag socket is adapted to accommodate a tag to be described in detail hereinbelow.

A variety of hangers different in the number of the hook-mounting bars 107 can also be used in the coat-applying apparatus 101. The hooks can be varied in the number, the shape, and the height of the arms 108*b*, and the size of the hook portion 108*c*. These hooks are in common with the shape and the size of the mounting-member 108.

<B. Process Chamber>(See FIGS. 6, 7, 11, and 12)

A Process Chamber 121 of substantially cylindrical polygonal configuration is provided. The chamber surrounded by a cylindrical outer wall may be kept in substantially air tight conditions. A variety of necessary ancillary facilities are provided around the chamber.

A vertically extending main shaft-disposing portion 122 of hexagonal cross section is provided through the central portion of the process chamber 121. The space defined between the process chamber 121 and the main shaft-disposing portion may be subdivided into six sectors of substantially identical size. Each of the boundaries between the sectors is provided with a partition wall respectively. A hanger gate 123 provided in each partition wall is adapted to be opened and closed upon transferring the hanger 105 from one sector to the adjacent sector.

The sectors are used as a transfer station 124, two coat-applying stations 125, 125', a heating station 126, a heat equilibrating station 127, and a cooling station 128. These stations are arranged in the order as mentioned above in the clockwise direction. The transfer station 124 is provided adjacent to the work supplying station to be described hereinbelow.

The transfer station 124 is served to receive the hanger 105 from the work supplying station, and to deliver the hanger 105 into the work supplying station. In the coat-applying stations 125, 125', the powder coating P is applied on the works 103, in the heating station 126, the powder coating P applied on the works 103 are baked under the effect of the high frequency induction heating, in the heat equilibrating station 127, the unevenness of the temperature of the works is eliminated, and in the cooling station 128 the hot works 103 are cooled. Either of the coat-applying stations 125, 125' may be used in accordance with the color of the coating to be applied on the works.

<B-1. Hanger-transferring Mechanism>(See FIGS. 6 and 7)

A vertically extending main shaft 131 is disposed within the main shaft disposing portion 122. The main shaft 131 may be rotated intermittently by means of a rotating mechanism 132 in the clockwise direction in the pitch of the central angle of 60 degree.

Radially and horizontally extending six hanger suspending bars 133 defining the angle of 60 degree between adjacent bars are provided on the top end of the main shaft 131 protruding through the top wall of the process chamber 121. A hanger holding member (not shown) including a holding portion for holding the hanging lug 109 of the hanger 105 is provided at the free end of each hanger suspending bar 133. The hanger-holding member can be rotated by means of the rotating mechanism 134. The hanger-holding member is rotated to reverse the hanger 105 for example for 180 degree.

The intermittent rotation of the main shaft 131 may be controlled to stop to place the hanger suspending bars 133 at the substantially central position of the stations 124–128.

The hanger 105 on which the works 103 to be coated are hanged may be received, and hooked at the transfer station 124 on the hanger holding member of the hanger suspending bar 133 so as to suspend therefrom. Then the hanger will be transferred through the process chamber 121 along the circular track. Thus the works hanged on the hanger 105 can be processed through the coat-applying station 125 or 125', the heating station 126, the heat equilibrating station 127, and the cooling station 128.

<B-2. Coat-applying Station>(see FIGS. 6, 7, and 14)

A spray gun shifter 141 and an associated powder supplier 142 are disposed on the outside of each of the coat-applying stations 125 and 125'. The spray gun shifter 141 includes a chain 143 movable in the vertical direction (see FIG. 14), motor 144 for driving the chain, and a spray gun 145 for injecting the powder coating P. The spray gun 145 is connected to the chain 143. The spray gun 145 has a comb shape including a plurality of nozzles disposed in the predetermined width slightly wider than the width of the hanger 105. The spray gun is disposed just in front of the hanger 105 within the coat-applying stations 125 and 125'. A conduit connected to the spray gun 145 extends through a vertical slit defined through the peripheral wall of the process chamber 121, and is connected to the chain 143.

The motor 144 switches the rotating direction in a predetermined timing so as to change the shifting direction of the spray gun 145. During the ascending and descending movement, the powder coating P is supplied to the spray gun 145 and injected therefrom toward the works 103. In order to charge the powder coating P to be injected from the spray gun 145 with static electricity, a means for charging the coating material, for example the friction tube or the corona discharge plug, is provided on the coating material supplying system or the end of the nozzles of the spray gun 145.

<B-3. Heating Station>(See FIGS. 6, 7, 11, and 12)

The heating station 126 is provided with a pair of high frequency induction coils 151 and 151'. Each of these high frequency induction coils 151 and 151' is formed by winding the wire on a plane to define an oblong swirl so that the coils has no bending portion unlike the high frequency induction coil 149. The dimension of the high frequency induction coils 151 and 151' are substantially identical with that of the hanger 105. The coils are accommodated within a pair of coil case 152 respectively in the upright position.

As can be seen from the above, the high frequency induction coils 151 and 151' are independent with each other. However, the coils are connected with each other by a stranded wire 153 of copper material. In this connection the coils are connected integrally in a circuit. The material employed for forming the coil is a thin copper tube through which the coolant can flow. The channels defined within the tubes are connected with a flexible hose 15.

A pair of slide blocks 155 provided on the bottom surface of each coil case 152 are adapted to be engaged with a pair of guide rails 156 laying on the floor of the heating station 126 so that the high frequency induction coils 151 and 151' can be shifted with respect to each other.

The lower end portion of one of the coil cases 152 is provided with a nut 157 having a right hand screw thread, and the lower end portion of the other of the coil cases 152 is provided with a nut 157 having a left hand screw thread. These nuts 157 are engaged with a screw shaft 158. The screw shaft 158 is adapted to be rotated by means of a stepping motor 159. Thus upon operating the stepping motor 159, the coil cases 152 are displaced in opposite directions so that the spacing between the coil cases 152 can be enlarged or narrowed.

<B-4. Heat Equilibrating Station and Cooling Station>(See FIG. 6)

The heat equilibrating station 127 is provided with a plurality of extreme infrared ray heater 161 of the power of 1–9 kW.

The cooling station 128 is provided with a cooling fan 162.

<C. Work Supplying Station>(See FIG. 6)

The work supplying station 171 is provided in front of the transfer station 124 of the process chamber 121. The work supplying station 171 includes an endless sending chain 173 running horizontally at the predetermined height. The chain 173 is provided with an equally spaced apart plurality of hanger holding members for holding the hanging lug 109 of the hanger 105. The chain 173 repeats movement and stop. That is, when the chain 173 stops when a hanger reaches a predetermined position with respect to the transfer station 124 and later re-move.

The hanger 105 with the works 103 may be hanged on the sending chain 173 at a predetermined position on the work supplying station 171. The hanger 105 is then transported by the sending chain 173 toward the process chamber 121, and transferred to the hanger suspending bar 133 at the transfer station 124 by means of transfer robot (not shown). After the hanger 105 transferred through the process chamber 121 and reached the transfer station 124, the hanger is transferred to the sending chain 173 by means of transfer robot (not shown), and then removed from the sending chain 173 and delivered therefrom.

<D. Control System>(See FIG. 14)

The control system employed in the powder coating apparatus of the present invention is defined basically as the SID-TAG system.

Shown in FIG. 14 is a control system 181 for controlling the number of displacement of the spray gun 145, the relative position of the high frequency induction coils 151 and 151', and the heating time by the coils.

The reference numeral 182 is added to a circuit for driving the spray gun shifting motor 144.

The reference numeral 183 is added to a coating valve incorporated into the coating supplying system connected to the spray gun 145. The coating valve 183 includes a control mechanism for varying the size of the opening therethrough in accordance with the electric command. The control mechanism is adapted to be controlled by the coating valve control circuit 184.

The reference numeral 185 is added to a circuit for driving the motor for displacing the coils and the reference numeral 186 is added to a position sensor such as proximity switch for detecting the origin of the displacement or the waiting position of the coil cases 152. The position sensor is adapted to output the signal when the coil cases reach the position defined by the two-dot chain line shown in FIG. 12.

The reference numeral 187 is added to a coil energizing circuit for controlling the amount of electricity delivered to the high frequency induction coils 151 and 151'. The coil energizing circuit includes a timer 187*a*.

The reference numeral 188 is added to a tag and the reference numeral 189 is added to the data reading circuit. The data on item number of the work are wrote into the tag 188 by means of writing means (not shown) and stored therein. The tag 188 is adapted to be mounted removably on the socket 110.

The data stored in the tag 188 may be transmitted from an antenna provided on the tag 188 to an antenna provided on the data reading circuit 186, and read out by means of data reading circuit 189.

The reference numeral 190 is added to a processor including a control data file in which the control data of the works identified by the item number indexed thereon such as the number of displacement of the spray gun 145, the degree of divergence of the coating valve 183, the color the coating to be applied, the amount of rotation of the stepping motor 159 determining the distance between the coils and the works, and the time period during which the high frequency induction coils 151 and 151' are energized, and a program data file in which the control data corresponding to the item number read out by means of data reading circuit 189 is read out from said control data file, and output the predetermined control signals to each control circuit 182, 184, 185, 197.

A part of the contents of the control data file is shown in the table 1.

| | Conditions | | | | |
|---|---|---|---|---|---|
| item No. | Number of displacement of spray gun | Valve open degree | Color | Distance between coils and works | Heating time (coil energizing period) |
| H-1 | 3 | 5 | Y | 50 mm | 2 min. 00 sec. |
| H-2 | 2 | 2 | Y | 20 mm | 2 min. 30 sec. |
| H-3 | 3 | 5 | Z | 50 mm | 1 min. 50 sec. |
| L-1 | 2 | 3.5 | Z | 30 mm | 1 min. 30 sec. |
| L-2 | 4 | 6 | Y | 80 mm | 2 min. 30 sec. |
| L-3 | 2 | 2 | Z | 20 mm | 2 min. 00 sec. |

The structure of the powder coat-applying apparatus 101 is as described hereinabove.

<E. The Method for Using and the Effect>

The method for using the powder coating apparatus 101 and the effect derived therefrom.

<E-1. Preliminary Treatment>

Before starting the coating operation, the data of each work such as the empirically obtained optimum control data and the data of the color to be applied are wrote into the control data file by the SID-TAG system.

When hooking the work to be coated on the hanger 105, kind and number of the hook 108 to be mounted on the hook-mounting bars 107 are suitably selected. To say more particularly, the height H of the arm 108*b* (see FIG. 10) should be longer than the distance between the hook hole 103*a* and the top end of the work. Although the hook 108 of the above-mentioned configuration may be employed for the work, which can be supported through only one portion, a hook including two arms 108*b* may be used for a work, which must be supported through two portions. When a work of a larger size is to be hanged, two hooks are provided on each hook-mounting bars 107, and when the works of smaller size is to be hanged, three hooks are provided on each hook-mounting bars 107.

Should the works be heated unevenly due to the difference in their position with respect to the high frequency induction coils 151 and 151', the hook of longer arm 108*b* may be used for the works of lower heating rate to enhance the effect of high frequency induction.

After the predetermined kind and number of hooks are mounted on the hook-mounting bars 107, the works to be coated are hanged thereon by inserting tightly the hook portion 108*c* of the hook 108 into the hook hole 103*a* of the work 103. The works hanged on the hanger should be the same kind.

The tag 188 on which the item number of the hooked works is wrote, is inserted into the tag socket 110.

The hanger 105 may be hanged on the sending chain 173.

<E-2. Coating Application>

Upon the hanger 105 with the works 103 reached the predetermined position near the transfer station 124, the data wrote on the tag 188 is received by the data reading circuit 189. The processor 190 read out from the data file the control data and the data for the color of the coating corresponding to the data on the item number received by the data reading circuit 189, convert the data into the predetermined control signal, and output the signal into the corresponding control circuit. The signal is output sequentially in a timing is synchronous with the signal for controlling the rotation of the main shaft 131.

The hanger 105 is then transferred to the hanger suspending bar 133 in a position in which the hook-mounting bars 107 are parallel with the straight line circumscribing the circle defined by the locus of the free end of the hanger suspending bar 133.

After transferred into the process chamber 121, the hanger 105 is further transferred into the coat-applying station 125 and stopped in front of the spray gun 145. Provided that the color to be applied on the works coincides with the color to be applied in this station, the coat-applying operation is done. Whereas the color to be applied on the works does not coincide with the color to be applied in this station, the hanger is transferred further into next coat-applying station 125' and then the coat-applying operation is effected. The coat-applying operation is controlled as mentioned hereinbelow.

The spray gun 145 is adapted to inject the powder coating P toward the hanger 105 with shifting vertically or ascending and descending in a predetermined number in accordance with the control signal output from the processor 190 into the spray gun shifter 141 and the associated powder supplier 142. The amount of the powder coating P is determined by the degree of divergence of the coating valve 183 controlled in accordance with the control signal. The hanger 105 and the works 103 are covered on one side with the powder coating P.

If it is necessary to coat both sides of the works, after the coating operation on the one side of the works is completed, the hanger may be rotated for 180 degree, and the coating operation on the other side of the works is started again. The hook-mounting bar 107 does not make interference on the coating operation since the entire body of each work is positioned below the hook-mounting bar 107. Further, the arm 108*b* of the hook 108 does also not make interference on the coating operation since the arm is made up from the thin wire material.

<E-3. Heating and So on>

After the powder coating is applied in the coat-applying station 125 or 125', the hanger 105 is transferred into the heating station 126. Before the hanger is transferred into the heating station 126, the coil cases 152 are displaced to the waiting position to enlarge the spacing therebetween. Thus the hanger 105 can be easily transferred into the spacing between the coil cases 152.

After the hanger 105 is transferred to such a position, the processor 190 output the control signal into the circuit 185 for driving the coil displacing motor. The stepping motor 159 rotates in a predetermined amount in accordance with the control signal to shift the coil cases forwardly into the predetermined position toward the hanger 105. Once the coil cases reach the predetermined position, a signal is output to the coil energizing circuit 189 and the high frequency induction coils 151 and 151' are energized.

The works themselves generate heat under the effect of the induction heating through the coils 151 and 151', and the powder coating P adhered on the surface of the works is baked. However, the hanger does not generate heat since the hanger is made of phosphor bronze to which no influence of the high frequency wave can be incurred. Thus the powder coating P does not baked on the hanger 105.

After the predetermined time period elapsed, the high frequency induction coils 151 and 151' are de-energized, and are displaced back to the waiting position.

After the heating operation is completed the hanger 105 is transferred into the heat equilibrating station 127 to reduce the unevenness of the temperature of the works, and further transferred into the cooling station 128 to cool the works, and then transferred into the transfer station 124 and delivered to the sending chain 173.

The powder coating P adhered on the hanger 105 may be dust off by a blower (not shown) provided within the heat equilibrating station 127 and recovered by the vacuum duct.

In accordance with the above-mentioned embodiment, the exchanging operation or position changing operation of the hook 108 can be made easily, and the interference on the injection of the coating on the work 103 can be reduced.

Further, in accordance with the above-mentioned embodiment, the heating effect of the high frequency induction coils 151 on all works 103 hanged on the hanger 105 will become uniform. The distance between each coil and the work 3 can be controlled.

In addition, in accordance with the above-mentioned embodiment, the processes essential for the quality of the coating such as the coat-applying process or the baking process can be controlled automatically as set preliminary in the unit of the hanger. Thus the coat-applying apparatus in accordance with the above mentioned embodiment is good at its operating efficiency.

While the second embodiment of the present invention have been illustrated and described, it should be obvious to those skilled in the art that various changes and modifications can be made without departing from the spirit and scope of the invention.

Although the SID-TAG system is used in the second embodiment, the present invention would not be limited to the embodiment employing such system.

In accordance with the present invention, a uniform and strong coating film without any unevenness can be formed more efficiently with the relatively compact apparatus.

What is claimed is:

1. An apparatus for powder coating of high frequency induction heating type comprising:

a coat-applying station for applying a powder coating on a surface of a work to be coated by electrostatic painting a heating station for baking the applied powder coating, including a pair of high frequency induction coils arranged opposite to and apart from each other, which, upon supply of heat frequency wave current, heat the work covered with the powder coating, thus proceeding baking of the powder coating from the work side, a hanger including a plurality of hook-mounting bars on which hooks are mounted, and being made of a material to which no heating influence of high frequency wave current can be incurred, and a hanger transfer means for transferring the hanger sequentially to each of the process stations, the hanger transfer means guiding the hanger between the opposite high frequency induction coils.

2. The apparatus according to claim 1 wherein the hanger is made of copper.

3. The apparatus according to claim 1, further including a carrier for displacing the work on a circular horizontal transferring track.

4. The apparatus according to claim 1 wherein the hook includes a mounting-member bended in an inverted "U" shape and an arm extending from one end of the mounting-member, and the hook-mounting bar is provided with a plurality of vertically extending recesses spaced apart in the longitudinal direction of the member for removably engaging the mounting-member of the hook.

5. The apparatus according to claim 4 wherein the mounting-member and an arm of the hook are formed from a wire of circular cross section, the top end of the arm extends downwardly from the mounting-member, and a hook portion of an arrow head shape for hanging the work is secured on the top end of the arm.

6. The apparatus according to claim 1, wherein the pair of high frequency induction coils are supported on coil supporting bases respectively, the bases can be displaced in opposite directions so that the spacing defined between the coil bases can be enlarged or narrowed, and a coil position control means for controlling the displacement of the coil supporting bases is provided.

7. The apparatus according to claim 6 further including a tag for storing a position control data of the pair of high frequency induction coils or a representative data thereof, adapted to be mounted on the hanger the data being varied in accordance with the works being hung on the hanger and/or the powder coating covering the works, a data reading circuit for reading the data stored in the tag, a processor generating a control signal on the basis of the data read through the data reading circuit, and a control circuit for controlling the position of the coils on the basis of the control signal.

8. The apparatus according to claim 1 further including a tag storing a control data or a representative data thereof controlling at least one of the number of the shifting operation of the spray gun of the heating station, the amount of the coating to be injected from the spray gun and the time for heating by means of the high frequency induction coils, adapted to be mounted on the hanger, the data being varied in accordance with the works being hunt on the hanger and/or the powder coating covering the works, a data reading circuit for reading the data stored in the tag, a processor generating a control signal on the basis of the data read through the data reading circuit, and a control circuit for controlling on the basis of the control signal the above mentioned items to be controlled.

* * * * *